United States Patent [19]

Ferina

[11] 4,163,362

[45] Aug. 7, 1979

[54] ORBITAL CLOCK

[76] Inventor: Ronald L. Ferina, 349 Bellmore Rd., East Meadow, N.Y. 11554

[21] Appl. No.: 845,026

[22] Filed: Oct. 25, 1977

[51] Int. Cl.[2] ..... G04B 19/00

[52] U.S. Cl. ..... 58/126 R; 58/2; 58/125 R

[58] Field of Search ..... 58/2, 3, 42.5, 43, 44, 58/45, 50 R, 106, 85.5, 126 R, 126 A, 125 R, 125 B; 40/53 R, 30, 33, 41, 44; 46/248, 264; 35/39, 45; 116/136.5, DIG. 6

[56] References Cited

U.S. PATENT DOCUMENTS

| | | | |
|---|---|---|---|
| 637,871 | 11/1899 | Jeager | 58/125 R |
| 733,796 | 7/1903 | Barthelemy | 40/33 |
| 864,533 | 8/1907 | Hadley | 58/125 R |
| 1,711,790 | 5/1929 | Johnson | 40/33 |
| 2,213,853 | 9/1940 | Whitehead | 58/126 R X |
| 2,607,188 | 8/1952 | Bourquin | 58/85.5 |
| 3,010,426 | 11/1961 | Rolfe | 116/136.5 |
| 3,029,528 | 4/1962 | Verson | 35/45 |
| 3,766,727 | 10/1973 | Didik | 35/45 X |

*Primary Examiner*—Ulysses Weldon
*Attorney, Agent, or Firm*—Mandeville and Schweitzer

[57] ABSTRACT

A new and improved means for visually displaying the time of day comprising generally asymmetrical three-dimensional bodies mounted for rotation about a common axis. A base structure houses a standard clock mechanism including three concentric drive shafts, corresponding to the "hours," "minutes" and "seconds" time measurements, respectively. The concentric drive shafts project from the top of the base structure and lie along a common axis of rotation. An irregularly shaped shaft support is attached to the base structure and extends upwardly in an appropriate contour whereby the outer end thereof intersects the common axis of rotation. The seconds drive shaft extends from the top of the base structure and is rotatably supported in a bearing arranged in the shaft support at the point of intersection with the common axis. The hours indicator comprises a first asymmetrical three-dimensional body. The hours drive shaft is in a driving engagement with the hours indicator to rotate the hours indicator 360° about the common axis once every 12 or 24 hours. The minutes indicator comprises a second asymmetrical three-dimensional body. The minutes drive shaft extends through the hours drive shaft and is in a driving engagement with the minutes indicator and rotates the minutes indicator about the common axis once every 60 minutes. The seconds indicator comprises a disc fixedly secured to the second drive shaft, which rotates the disc once every 60 seconds. The seconds drive shaft extends through a moving fit with each of the hours and minutes indicators to the bearing in the shaft support. The relative positions between the rotating asymmetrical bodies and the shaft support indicates the hour and minute of the day.

7 Claims, 3 Drawing Figures

10
11
12
13
14
15
16
17
18
19
20
21
22
23
24
26
27
28
29
30
31

ORBITAL CLOCK

BACKGROUND AND SUMMARY OF THE INVENTION

The invention relates to clock mechanisms and constructions and more particularly to a novel means for visually displaying the time of day. Many prior art clocks and watches have been designed to provide unusual and interesting visual effects which convey horological information. Illustrative, but by no means exhaustive of prior art patents are the Lakens U.S. Pat. No. 3,798,892 and Worthington U.S. Pat. No. Des. 218,947. In each of these patents, the conventional hour, minute and second hands are replaced by disc indicators cantilevered on telescopic drive shafts and rotatable in their respective planes. The discs each include different color patterns and the various relationships between the color patterns caused by the rotating discs indicate the time of day.

It is the primary objective of the present invention to provide a highly unique arrangement of moving parts for indicating the time of day. Generally the horological information is visually displayed by the dynamic, spacial positions between rotating three-dimensional bodies in relation to a fixed support member. In one advantageous form of the invention, the hours and minutes indicators comprise asymmetrical bodies rotatable about a common axis and supported in space on a drive shaft means extending along the common axis. The drive shaft means is mechanically interconnected with a standard clock mechanism and is held by moving fit bearings at both ends thereof. The asymmetrical bodies are therefore supported for rotation between two points.

To indicate the hour and minute information, the fixed support member is arranged adjacent the rotating bodies. The spacial relations between the asymmetrical bodies and the fixed member will constantly change and each position of the particular body within a 360° arc of rotation will correspond to a particular hour of the day or minute of the hour. Seconds information may be displayed by a third asymmetrical body or by a disc rotating in its plane and provided with suitable marking at its circumference.

The present invention therefore provides an innovative arrangement for exhibiting horological information in three-dimensional space. The asymmetrical bodies are rotated bodily and convey time information through a dynamic spacial relation as opposed to a conventional plane representation. The clock conveys time information in a visually exciting manner which is aesthetically pleasing and lends itself well to attractive, artistic rendition.

For a more complete understanding of the above and other features and advantages of the present invention, reference should be made to the following detailed description of a preferred embodiment and to the accompanying drawings.

DETAILED DESCRIPTION OF A PREFERRED EMBODIMENT

Figures 1, 2, 3:
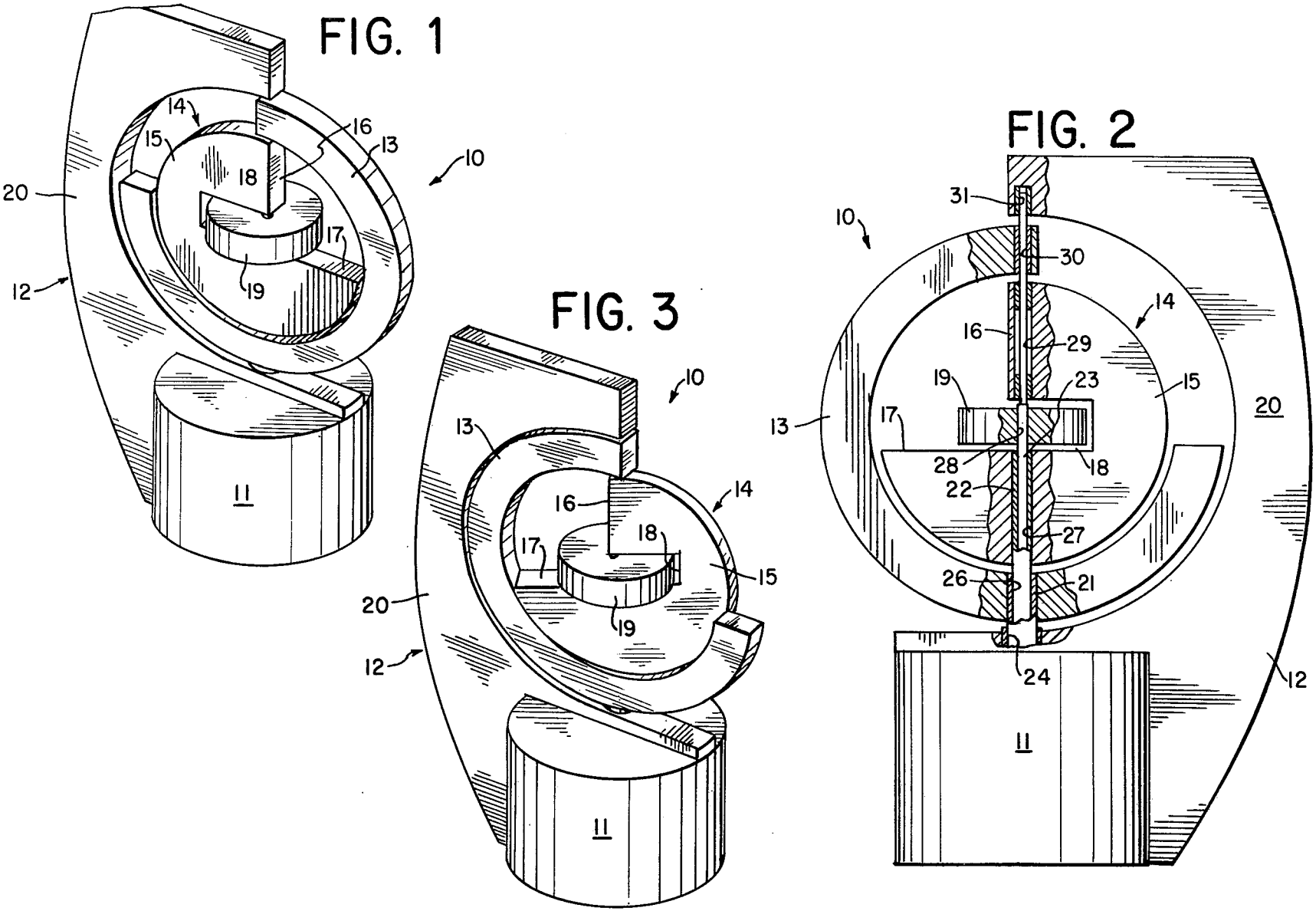
FIG. 1 is an isometric view of a clock built in accordance with the teachings of the present invention, and indicating 6:00.
FIG. 2 is a side cross-sectional plan view of the clock of FIG. 1.
FIG. 3 is an isometric view of the clock indicating approximately 12:25.

Referring now to the drawings, and initially to FIG. 1 thereof, there is illustrated a clock built in accordance with the present invention and designated generally by the reference numeral 10. A cylindrical base 11 houses a standard clock mechanism (not shown) and mounts an irregularly shaped fixed support member 12. The member 12 includes an arcuate portion 20 which extends through an arc of approximately 180° in the area directly above the base 11. The member 12 acts as a support structure for the time indicators and as a fixed reference point in the time indicating system, as will be described hereinafter.

In accordance with the invention, the hours indicator 13 and minutes indicator 14 each comprise a generally asymmetrical three-dimensional body. The hours indicator 13 is a ring-like body extending through an arc of approximately 270°. The minutes indicator 14 is a generally J-shaped body wherein a disc 15 includes an angular slot formed by the edges 16, 17 of the disc 15 and a rectangular opening 18 formed at the center area of the disc 15. The seconds indicator 19 is in the form of a disc. The three time-indicating bodies are arranged and configured such that the minutes indicator 14 fits within the area circumscribed by the ring-like hours indicator 13 and the seconds indicating disc 19 fits within the rectangular opening 18 of the minutes indicator 14.

Referring now to FIG. 2, three telescoping output drive shafts 21, 22, 23 extend through an opening 24 formed through the support member 12. The shafts 21, 22, 23 are connected to the outputs of any standard clock mechanism which is housed in the base 11, as discussed above. The drive shaft 21 is the hours drive, shaft 22 is the minutes drive and shaft 23, the seconds drive. The hours drive shaft 21 is in a tight-fitting relation with an opening 26 formed in a lower portion of the hours indicator 13, whereby the ring-like body will be rotated through 360° by the shaft 21 once every 12 or 24 hours. The minutes drive shaft 22 is in a tight-fitting relation with an opening 27 formed in a lower portion of the minutes indicator 14 to rotate the minutes indicator 14 through 360° once every 60 minutes.

In a similar manner, the seconds drive shaft 23 supports and drives the seconds indicator 19 by a tight fit with an opening 28 formed through the center of the disc 19. To particular advantage, the seconds drive shaft 23 continues through bearing-lined openings 29, 30 formed through an upper portion of the minutes indicator 14 and hours indicator 13, respectively, to a bearing 31 arranged at the upper end of the arcuate portion 20 of the support member 12. The shaft 23 and openings 29, 30 are in a moving fit relation and the shaft is journaled for rotation in the bearing 31. In this manner, the hours indicator 13 and minutes indicator 14 are supported at one end thereof by their respective drive shafts 21, 22 and at the other end thereof by the moving fit placement of the seconds drive shaft 23.

It can be appreciated that with the above-described arrangement, the three time indicating bodies 13, 14, 19 will be supported for bodily rotation about a common axis and will define constantly changing spacial relationships between the respective bodies 13, 14, 19 and the fixed member 12. As illustrated in FIG. 1, the composite form assumed by the bodies 13, 14, 19 and member 12 will indicate 6:00 by definition. When the hour indicator 13 has been rotated through an arc of 90° whereby the open portion of the ring-like structure is facing into the page, this will be the 9:00 position. After 180° of rotation and the open portion is away from the arcuate portion 20 of the member 12, the hours indicator will illustrate 12:00, and so on. In a like manner, rotation of the minutes indicator 14 will indicate a quarter past, half past the hour and so on. For example, FIG. 3 shows the relative positions of the bodies 13, 14 when the clock indicates approximately 12:25. The seconds indicating disc 19 may include markings or numbers to visually display the seconds information.

The present invention, therefore, provides a highly unique means for displaying horological information. In contrast to heretofore utilized clock face arrangements, the rotating asymmetrical bodies convey the time data in three-dimensional space through constantly changing solid geometric relationships. Moreover, the novel utilitarian features disclosed herein contain an aesthetic aspect which enhances the functioning of the time piece.

In one of the particularly advantageous forms of the invention, the rotating asymmetrical bodies include relatively flat, planar bodies, rotating one within the other such that the angularity of their principal planes, indicative of the time, is readily evident at a glance. The elements can be either physically asymmetrical or asymmetrical as a result of color combinations, for example, so that 180° rotational ambiguities are avoided.

The structure of the invention, utilizes coaxial shafts as in a conventional clock mechanism. However, the seconds shaft not only passes through the hours and minutes shafts in the conventional manner, but also passes through outboard bearings provided in the minutes and hours indicating members, and is in turn supported at its outboard extremity by a fixed bearing support. This structure enables a relatively large, three-dimensional unit to be constructed, in a rugged, serviceable form.

The orbital clock structure of the invention, lends itself to a great variety of unusual and pleasing artistic renditions, such that the ultimate clock, while having utilitarian function, also may comprise unusual and attractive works of art.

It should be understood, of course, that the specific form of the invention herein illustrated and described is intended to be representative only as certain changes may be made without departing from the clear teachings of the disclosure. Accordingly, reference should be made to the following appended claims in determining the full scope of the invention.

I claim:

1. In a timepiece, means for visually displaying the time of day, which comprises (a) a clock mechanism having a minutes drive shaft and an hours drive shaft, (b) a first asymmetrical, three-dimensional body in driving engagement with and partially supported by said hours drive shaft at a first portion thereof, said first body having a height dimension which is substantially larger than the width dimension thereof, (c) a second asymmetrical, three-dimensional body in driving engagement with and partially supported by said minutes drive shaft at a first portion thereof, said second body having a height dimension which is substantially larger than the width dimension thereof, (d) a stationary reference member positioned adjacent said first and second asymmetrical bodies, and (e) a secondary support means in a moving fit relation to each of said bodies for partially supporting said bodies at second portions thereof, (f) said second portion of each body being spaced from said first portions in the height direction, (g) said asymmetrical bodies being arranged and configured whereby they are rotatable by said hours and minutes drive shafts, respectively, about an axis whereby the spacial relation between said bodies and the reference member indicates the time of day.

2. The time display means of claim 1, further characterized by (a) said clock mechanism being housed in a base structure, (b) said hours and minutes drive shafts being co-axial whereby the asymmetrical bodies are rotatable about a common axis, (c) said stationary reference member comprising a fixed member associated with said base structure and intersecting said common axis of rotation, (d) said secondary support means comprising a seconds drive shaft operatively associated with said clock mechanism and extending through said base structure along said common axis to a moving fit relation with said fixed member, (e) a seconds indicator means in driving engagement with said seconds drive shaft and (f) said first and second asymmetrical bodies being at least partially supported by said seconds drive shaft.

3. The time display means of claim 2, further characterized by (a) said fixed member comprising an irregularly shaped body mounted to said base structure and including an arcuate portion adjacent said asymmetrical bodies and intersecting said common axis of rotation.

4. The time display means of claim 2, further characterized by (a) said first asymmetrical body comprising a ring-like body extending through an arc of approximately 270°, (b) said ring-like body being supported at a lower portion thereof by said hours drive shaft and at an upper portion thereof by a moving fit relation with said seconds drive shaft.

5. The time display means of claim 4, further characterized by (a) said second asymmetrical body comprising a J-shaped body supported, within the area circumscribed by said ring-like body, at a lower portion thereof by said minutes drive shaft and at an upper portion thereof by a moving fit relation with said seconds drive shaft.

6. In a timepiece comprising a housing including a clock mechanism having two coaxial drive shafts for operating, respectively, an hours and a minutes indicator, means for visually displaying the time of day, which comprises (a) a fixed member associated with said housing and intersecting the common axis of said drive shafts, (b) a rod-like support means extending between said housing and said fixed member along said common axis, (c) a first asymmetrical, three-dimensional body in driving engagement with and partially supported by said hours drive shaft at a first portion thereof and being at least partially supported by said rod-like support means at a second portion thereof, (d) a second asymmetrical, three-dimensional body in driving engagement with and partially supported by said minutes drive shaft at a first portion thereof and being at least partially supported by said rod-like support means at a second portion thereof, (e) said first portion of each body being spaced from the second portion thereof, and (f) a reference member positioned adjacent said first and second asymmetrical bodies, (g) said first and second asymmetrical bodies being rotatable about said common axis by said hours and minutes indicators respectively, whereby the spacial relation between said bodies and said reference member indicates the time of day.

7. The time display means of claim 6, further characterized by (a) said rod-like support means comprising a seconds drive shaft operatively associated with said clock mechanism, and (b) a seconds indicator in driving engagement with said second drive shaft.

* * * * *